US011457741B2

(12) United States Patent
Frankel et al.

(10) Patent No.: US 11,457,741 B2
(45) Date of Patent: Oct. 4, 2022

(54) FOLDING SWIVEL CHAIR SUPPORT FRAME

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 17/184,749

(22) Filed: Feb. 25, 2021

(65) Prior Publication Data

US 2022/0265048 A1 Aug. 25, 2022

(51) Int. Cl.
*A47C 3/18* (2006.01)
*A47C 4/28* (2006.01)

(52) U.S. Cl.
CPC ..... *A47C 3/18* (2013.01); *A47C 4/286* (2013.01)

(58) Field of Classification Search
CPC ..... A47C 3/18; A47C 4/286
See application file for complete search history.

(56) References Cited

U.S. PATENT DOCUMENTS 5,567,014 A * 10/1996 Fitch ..... A47C 3/18 297/344.21
2002/0117878 A1* 8/2002 Fox ..... A47C 3/18 297/16.2
2014/0306493 A1* 10/2014 Obolewicz ..... A47C 3/18 297/16.2
2020/0329873 A1* 10/2020 Sun ..... A47C 3/18

* cited by examiner

*Primary Examiner* — Anthony D Barfield
(74) *Attorney, Agent, or Firm* — Merek, Blackmon & Voorhees, LLC

(57) ABSTRACT

A folding swivel chair support frame, which includes a seat frame and a chair leg frame; and the seat frame includes a U-shaped first support rod, a second support rod, and a cushion rod that are hinged to each other, and a foldable connection is formed by a turntable and a shaft rod that is locked on the first support rod. The seat frame is inserted into the guide tube of the chair leg frame by means of the shaft rod to form a docking position with the chair leg frame, and the turntable on the seat frame abuts against the support plate of the chair leg frame to from a rotatable load-bearing support.

10 Claims, 9 Drawing Sheets

FOLDING SWIVEL CHAIR SUPPORT FRAME

BACKGROUND OF THE INVENTION

Field of the Invention

The invention is to folding chairs. Specifically, it relates to a folding swivel chair support frame. In particular, the upper and lower parts can be taken apart for folding and storage, and the upper and lower parts can work by swivel against each other.

Technical Background

Chinese Application CN201710831683.9, disclosed as a split folding furniture support device comprises an upper support portion and a lower support portion. The upper support section is connected and secured to the lower support section as the shaft inserts into the guide tube. The lower end of the upper main plate abuts against the upper end of lower main plate to form a load-bearing support. The device can be used to make folding tables, thin waist stool and rotary backrest chair with split, fold and rotation functions. This structure provides a rotatable solution by simply butting the upper and lower parts, but the matching upper support part is more complicated and is constrained by its folding method, which limits the ability of the product to extenf and transform, especially due to the diversified design of the seat part.

Chinese Application CN201920569842.7 discloses a swivel chair with adjustable leg tube length. It comprises a chair frame assembly, a seat leg connection assembly and a leg tube assembly. The chair frame assembly is connected to the leg tube assembly through the seat leg connection assembly rotatable. The leg tube assembly includes a bushing for mounting the leg connection assembly, an upper leg tube holder, four upper leg tube connectors, two telescopic upper leg tubes, two locking mechanisms, two lower leg tubes, four universal foot pads, four tie rods, a tie rod seat, a tie rod seat holding tube, and two necked upper leg tubes. The back tube can be flipped forward and folded through the flip seat. The two retractable upper leg tubes and the two necked upper leg pipes can be folded inwardly, and the lower leg pipe can be stretched upwardly and downwardly in the telescopic upper leg tube through unlocking and locking of the locking mechanism. This structure gives a beneficial inspiration for the back tube to be flipped and folded forward, but the chair frame assembly and the leg tube assembly need to be connected through the seat leg connection assembly, which may be a deficiency.

How to overcome the shortcomings of the existing technology and provide a solution that is split and foldable and has a large expansion space for the chair frame is an object of the present invention.

SUMMARY OF THE INVENTION

An objective of the present invention is to design a split seat frame in which the seat cushion rod is supported by two support rods bent into a U shape, and is folded and connected with the turntable and the shaft rod and enters the chair leg guide tube through the shaft rod to form a folding swivel chair support frame that can be connected in a flexible manner and can achieve relative rotation.

The technical proposal of the invention is achieved in at least the following ways:

The folding swivel chair support frame includes seat frame and chair leg frame;

The chair leg frame includes supporting plate, sliding plate, supporting legs, connecting rods, and guide tube; the ends of several supporting legs are hinged on the supporting plate. One end of the corresponding number of connecting rods is hinged on the supporting leg, and the other end is hinged on the sliding plate. The guide tube is locked on the through hole of the support plate and passes through the central hole of the sliding plate.

The chair leg frame forms a rotatable support to the seat frame through the support plate and the guide tube.

This invention may have one or more of the following characteristics:

The seat frame includes a turntable, and a first support rod, a second support rod, and a seat cushion rod that are bent into a U-shape. The seat cushion rod of the U-shaped structure forms a support for the seat cushion. The two bending sections of the first support rod and the second support rod are rotatably hinged on the two bending sections of the seat cushion rod to jointly form a support for the seat cushion rod. The middle section of the first support rod locks to the shaft rod. The shaft rod can pass through a reserved hole on the turntable. The middle part of the middle section of the second support rod is hinged on the turntable, and the first support rod and the second support rod are formed by the turntable in a foldable connection.

When the seat frame is opened in place, the plane formed by the seat cushion rod bent into a U-shaped structure is close to the horizontal plane, the middle section of the seat cushion rod faces the front part of the seat, and the two bending sections are on both sides of the seat.

The two bending sections of the seat cushion rod also have a vertical re-bending of 10 degrees to 20 degrees near the middle section, so that the seat cushion rod forms two planes, and a fabric support strip is also connected to the place where the two bending sections are re-bent.

The two hinged ends of the second support rod and the seat cushion rod each have an upward second rod extension section, and the backrest support is formed by two second rod extension sections.

The two hinged ends of the first support rod, second support rod, and the seat cushion rod have upward extensions, which are respectively the first rod extension and the second rod extension, and the backrest support is formed by two second rod extensions. An armrest rod is hinged between the end of the first rod extension and the second rod extension.

The armrest rod is provided with a hinge seat at the hinged position of the end of the first rod extension. The hinge seat is provided with a transverse slot hole, and the hinged rivet passes through the transverse slot and is fixed at the end of the first rod extension section A type of folding swivel chair support frame. It includes seat frame and chair leg frame;

The chair leg frame includes supporting plate, sliding plate, supporting legs, connecting rods, and guide tube; the ends of several supporting legs are hinged on the supporting plate. One end of the corresponding number of connecting rods is hinged on the supporting leg, and the other end is hinged on the sliding plate. The guide tube is locked on the through hole of the support plate and passes through the central hole of the sliding plate.

The chair leg frame forms a rotatable support to the seat frame through the support plate and the guide tube.

The seat frame includes a turntable, a seat cushion rod, and a first support rod and a second support rod bent into a U-shaped structure. The ends of the first support rod and the second support rod are bent on the same side at the bending sections and are rotatably hinged on a cushion rod. A seat ring for supporting the seat fabric is locked between the two seat cushion rods, and the connection between the two seat cushion rods is formed by the closed or open seat ring. The center part of the middle section of the first support rod locks the shaft rod, and the shaft rod can pass through the reserved hole on the turntable. The middle part of the middle part of the second support rod is hinged on the turntable, and the turntable constitutes the first support rod and the second support rod foldable association.

The bending section of the first support rod is longer than the bending section of the second support rod, correspondingly supporting the rear part of the seat, and raising the seat cushion rod and the rear part of the seat ring into a tilted state of low front and high rear. An auxiliary rod is also hinged to the bending sections of the first support rod and the second support rod and extends out of the first support rod.

The shape of the seat ring may be one of the following shapes: round; ellipse; rectangle; triangle; pentagon; hexagon; octagon; trapezoid; gourd shape; bread shape with rounded upper and square bottom. The seat ring is preferably a closed structure.

The shape of the seat ring may be one of the following shapes: round; ellipse; rectangle; triangle; pentagon; hexagon; octagon; trapezoid; gourd shape; bread shape with rounded upper and square bottom; the seat ring is an open structure, and the opening is located between the bending section of the second support rod at the front part of the seat.

The split seat frame of the present invention adopts the shaft rod to pair with the guide tube and rests on the support plate by means of the turntable, which not only forms the connection and positioning between the seat frame and the chair leg frame, but also provides the rotation axis center for the rotation of the seat frame. The two U-shaped support rods that support the seat cushion rod are connected by the turntable. The folding and opening process relies on the shaft to guide without departing from the restriction of the turntable, and the operation is smoother. The seat cushion rod can directly support the seat cushion to form a simple stool, and a support rod extends upwards at both ends to form a swivel chair with backrest, which can be further expanded to form a swivel chair with armrests, and can also directly use the seat cushion rod to support various shapes of seat rings to form more types of folding chairs with rotating functions.

BRIEF DESCRIPTION OF THE DRAWINGS

Similar reference characters denote corresponding features consistently throughout the attached drawings. Namely, in the drawings the following reference numbers refer to the following part as enumerated in Table 1.

TABLE 1

| Reference | Feature | Reference | Feature |
|---|---|---|---|
| 100 | seat frame | 8 | support leg |
| 1 | first support rod | 81 | omni directional wheel |
| 11 | first rod extension | 9 | connecting rod |
| 2 | second support rod | 10 | guide tube |
| 21 | second rod extension | 300 | seat cushion |
| 3 | seat rod | 301 | seat cushion area |
| 31 | fabric support | 302 | backrest area |
| 32 | seat ring | 303 | knitted strap |
| 33 | auxiliary rod | 400 | armrest rod |
| 4 | shaft rod | 401 | hinge seat |
| 5 | turntable | 402 | traverse slot hole |
| 200 | chair leg frame | 403 | rivet |
| 6 | supporting plate | X | bending section |
| 7 | sliding plate | Y | middle section |

DETAILED DESCRIPTION OF THE PREFERRED EMBODIMENT(S)

Example 1

Figure 1:
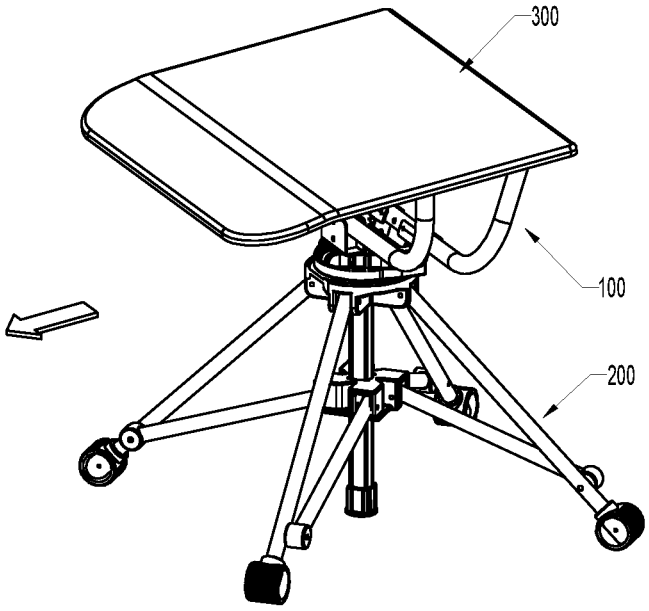
FIG. 1 is a 3D illustration of the chair support frame.
Figure 2:
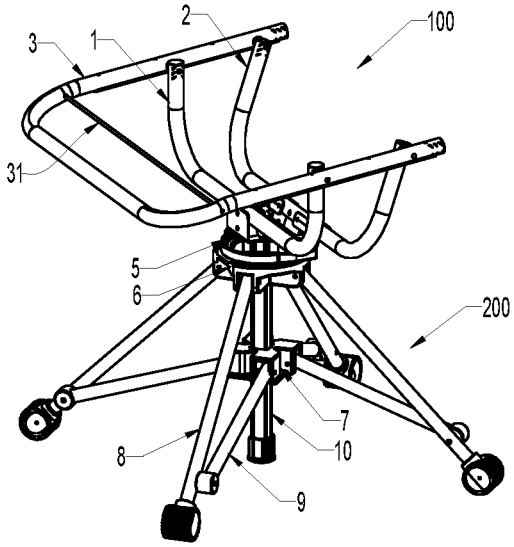
FIG. 2 is an illustration of the side view of the chair support frame.
Figure 3:
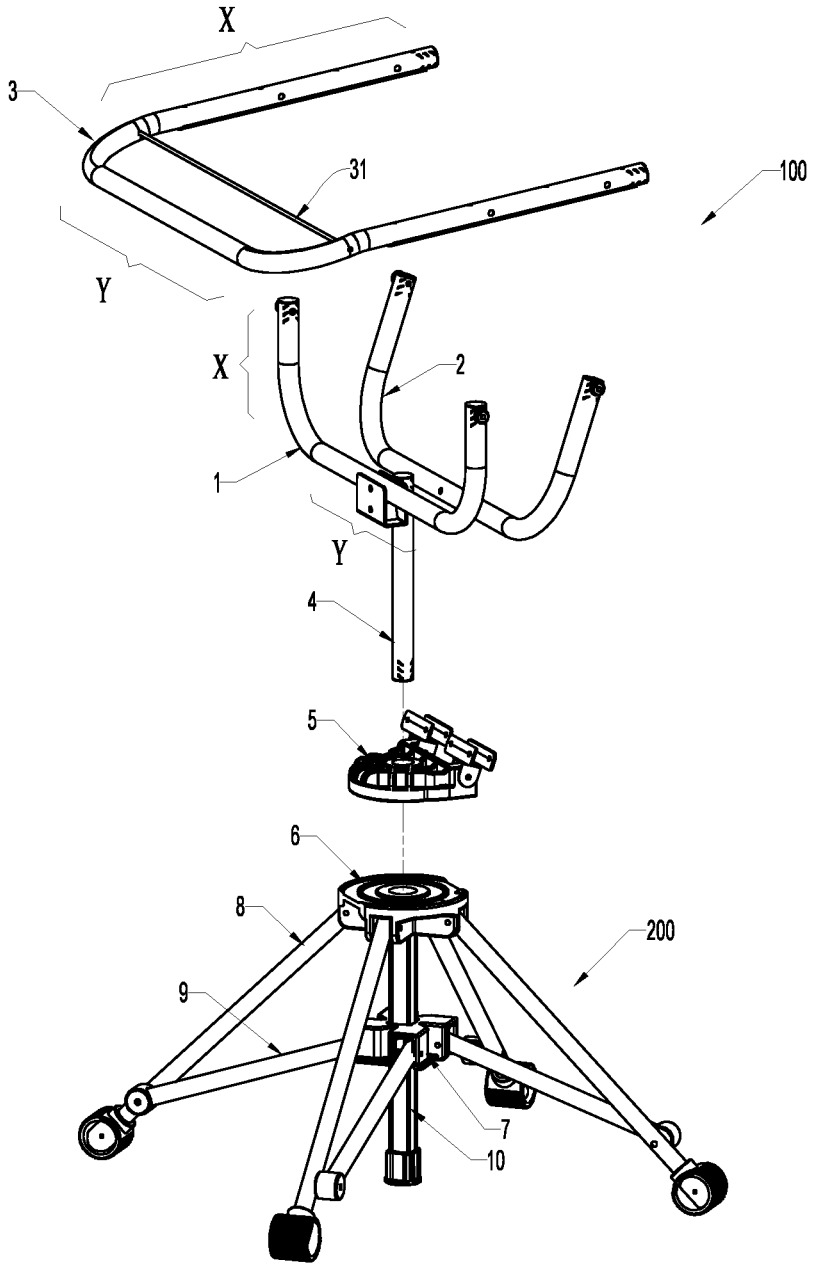
FIG. 3 is a sectional illustration of the chair support frame.
Figure 4:
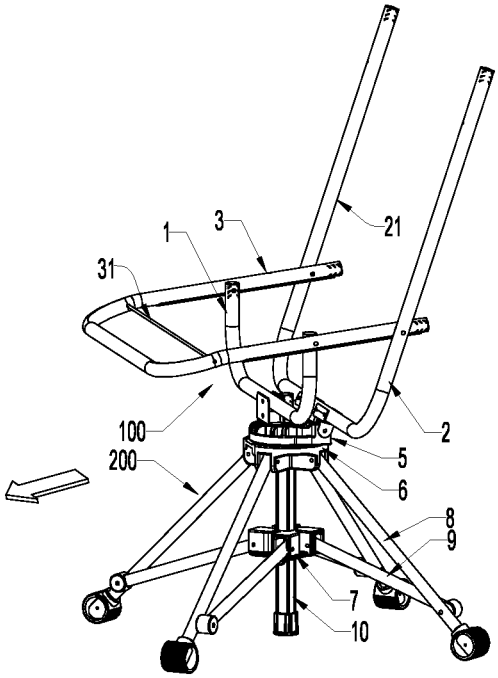
FIG. 4 is an illustration of the backrest swivel chair support frame.
Figure 5:
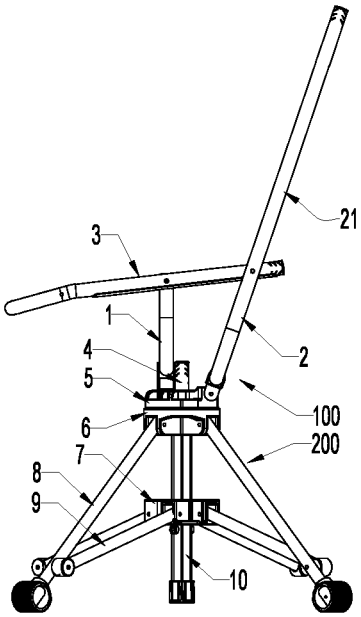
FIG. 5 is a side view of the backrest swivel chair support frame.

FIGS. 1-3 show a chair or bar stool support frame providing the most basic function of a swivel chair. It also includes seat frame 100 and chair leg frame 200. The two parts are separate and are independently foldable structures. In particular, this structure involves three U-shaped structural rods. In addition to their respective reference numerals, the letter X represents the bending section in the U-shaped structure, and Y represents the middle section in the U-shaped structure. However, the U shape structure is just a figurative description, which could include other equivalent structures such as that of a semicircular arc or a V-shaped structure.

The seat support frame 100 includes a first support rod 1, a second support rod 2, and a seat cushion rod 3 bent into a U-shaped structure, as well as a shaft rod 4 and a turntable 5. The two bending sections of the first support rod 1 and the second support rod 2 are rotatably hinged on the two bending sections X of the seat cushion rod 3 to jointly form a support for the seat cushion rod 3. the middle section Y of the first support rod 1 locks the shaft rod 4, the shaft rod 4 can pass through the reserved hole 51 on the turntable 5, the middle part of the middle section Y of the second support rod 2 is hinged on the turntable 5, and the turntable 5 forms the first support rod 1 and the second support rod 2 in a foldable connection.

When the seat frame 100 is opened in place, the plane formed by the seat cushion rod 3 bent into a U-shaped structure is close to the horizontal plane, and the middle section Y of the seat cushion rod 3 faces the front part of the seat, and the two bending sections X are on both sides of the seat. The seat cushion rod 3 of the U-shaped structure forms a support for the seat cushion 300. The front part of the seat is in the direction of the arrow in FIG. 1.

This solution is used as a special use case of the stool, that is, the plane of the seat cushion rod 3 should be a horizontal plane, which can maintain a slightly inclined state as a bar stool, with seating directionality. On the seat cushion rod 3, a hard seat cushion, such as a molded composite board or a plastic seat cushion 300, can be directly locked. For seat cushions with flexible fabrics, such as Oxford cloth, it is better to add a rod to the U-shaped opening of the seat cushion rod 3 to form a closed structure, or directly bend it into a closed loop structure, such as a rectangular circle and an oval circle. It can form a tight support around the flexible fabric and can keep the seat cushion of the stool flat. And for the hard cushion solution, the cushion rod 3 itself can be understood as the edge part of the hard cushion or integrated into the cushion.

In one solution where the seat cushion is tilted forward or horizontal, the two bending sections X of the seat cushion rod 3 also may have a 10 to 20 degree vertical downwardly bending near the middle section, so that the seat cushion rod 3 constitutes two planes, and a fabric support strip 31 is also connected to the rebend of the two bending sections X, which can prevent the soft fabric seat cushion 300 from sinking. The middle section Y of the seat cushion rod 3 slightly sinks downward after rebending to avoid putting one's thighs directly on the middle section Y.

Chair leg frame 200 includes supporting plate 6, sliding plate 7, supporting legs 8, connecting rods 9, and guide tube 10; the ends of several supporting legs 8 are hinged on the supporting plate 6. One end of the corresponding number of connecting rods 9 is hinged on the supporting leg 8, and the other end is hinged on the sliding plate 7. The guide tube 10 is locked on the through-hole of the support plate 6 and passes through the central hole of the sliding plate 7. The sliding plate 7 can slide along the outer wall of the guide tube 10 as it is opened or folded. The chair leg frame 200 is an existing technology, and is similar to a tripod in photographic equipment, so its functions are not described in detail.

Figure 7:
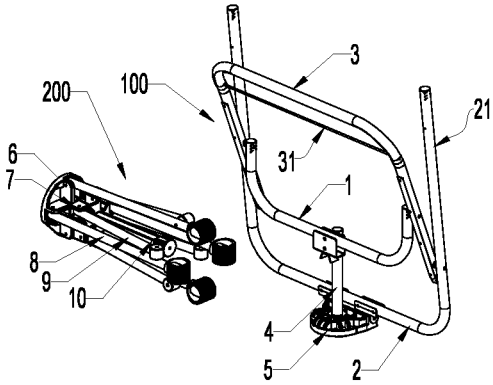
FIG. 7 is an illustration of the folded state of the backrest swivel chair support frame.

The chair leg frame 200 forms a rotatable support for the seat frame 100 through the support plate 6 and the guide tube 10, and the seat frame 100 can also easily be removed from the chair leg frame 200. Both can be folded. The folded chair leg frame 200 is laterally attached to the side of the seat cushion frame 100, and is fastened by a knitted strap or elastic band to form a portable and storeable whole, as shown in FIG. 7.

Example 2

FIGS. 4-7 show a swivel chair bracket with a backrest, which is also the most basic type, not only meeting the needs of comfortable sitting and reclining, but also having the characteristics of lightness. The general structure is the same as the above example, except that the second support rod 2 is designed to extend. Specifics are preferably as follows:

The two hinged ends of the second support rod 2 and the seat cushion rod 3 have an upward second rod extension 21. The two second rod extensions 21 constitute a backrest support, and the upper backrest, such as hard backrest or flexible backrest material, can be directly locked on the second rod extension 21.

Figure 6:
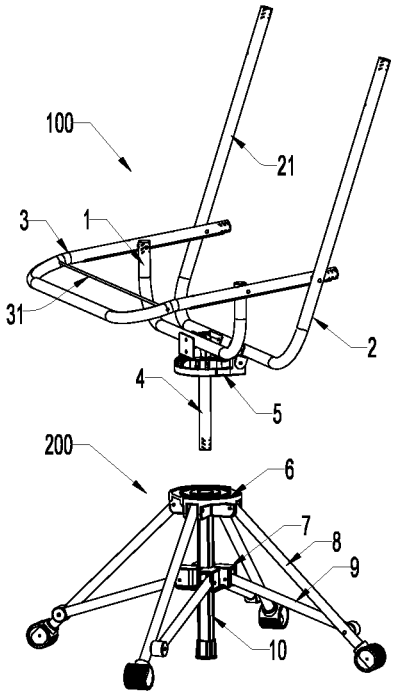
FIG. 6 is an illustration of the split state of the backrest swivel chair support frame.

As shown in FIG. 6, the seat frame 100 with seat cushion and backrest can be taken out from the seat frame 200 as a whole. The seat frame 100 is partially folded, and the middle section Y of the seat cushion rod 3 and the second rod extension 21 swing towards each other and fold in half. When the chair leg frame 200 is folded, the sliding plate 7 can be lifted upwards or the open part of the connecting rod 9 and the supporting leg 8 can be held together by a user's hand. The split body is folded in place, and the chair leg frame 200 is positioned horizontally and attached to the seat frame 100, especially on the side of the seat cushion rod 3 and the first support rod 1 in order to fill the space occupied by the turntable 5. Then a knitted strap or elastic band reserved at the bottom of the seat cushion rod 3 or the underside of the seat cushion is used to fasten the folded chair leg frame 200 to form a whole for easy storage and carrying, as shown in FIG. 7.

Example 3

Figure 8:
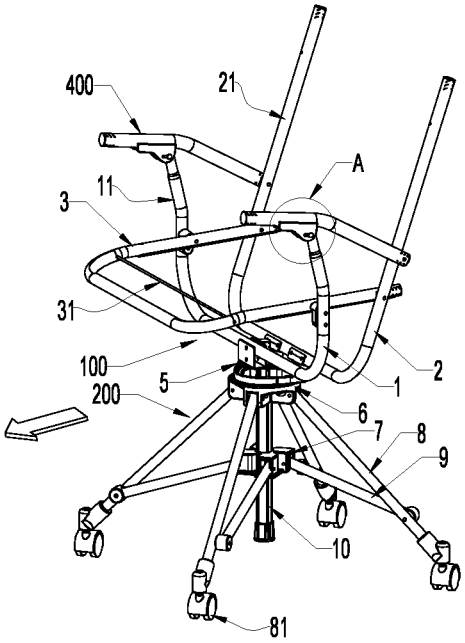
FIG. 8 is an illustration of the armrest swivel chair support frame.
Figure 9:
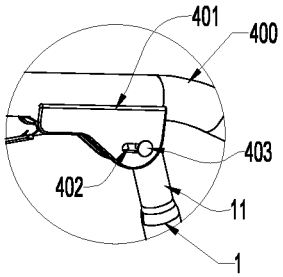
FIG. 9 shows a zoomed image of selection A from FIG. 8.
Figure 10:
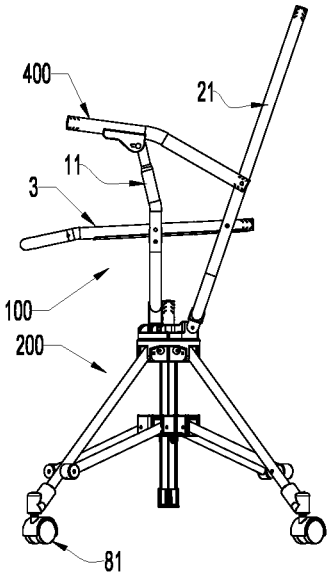
FIG. 10 is a side view of the armrest swivel chair support frame.

FIGS. 8-1 show a swivel chair bracket with armrests, forming a more complete folding swivel chair, and can be equipped with omni directional wheels 81 on the supporting legs 8, to meet the requirements of more mobile business occasions. Specific, preferred structure is as follows:

The two hinged ends of the first support rod 1, second support rod 2, and the seat cushion rod 3 have upward extensions, which are respectively the first rod extension 11 and the second rod extension 21, and the backrest support is formed by two second rod extensions 21. An armrest rod 400 is hinged between the end of the first rod extension 11 and the second rod extension 21.

Figure 11:
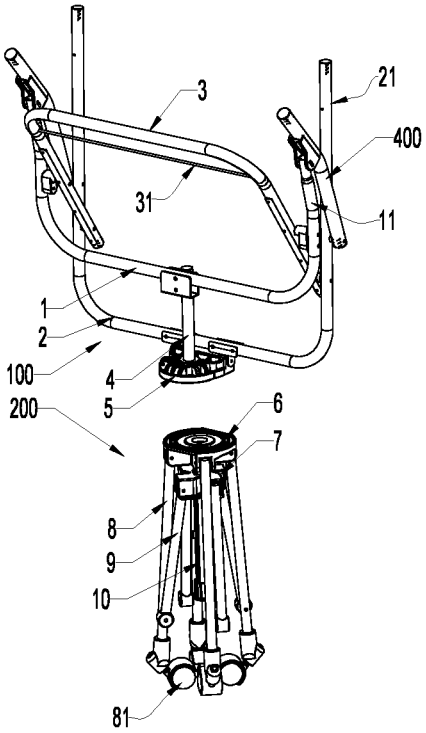
FIG. 11 is an illustration of the split and folded state of the armrest swivel chair support frame.

Furthermore, the armrest rod 400 is provided with a hinge seat 401 at the hinged position of the end of the first rod extension 11. The hinge seat 401 is provided with a transverse slot 402, and the hinged rivet 403 passes through the transverse slot 402 and is fixed in the end of the first rod extension 11, which not only forms a constraint, but also avoids the position space required for opening and folding into place. The split folded state is shown in FIG. 11.

Example 4

Figure 12:
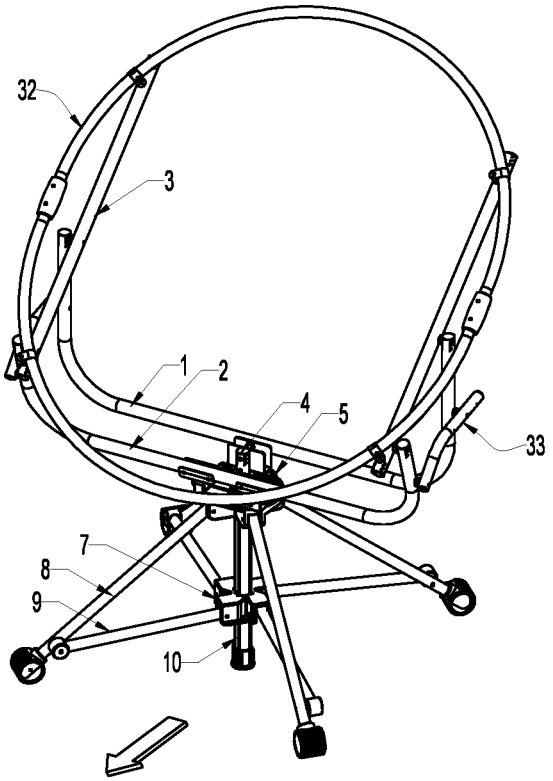
FIG. 12 is an illustration of the model swivel chair support frame.
Figure 13:
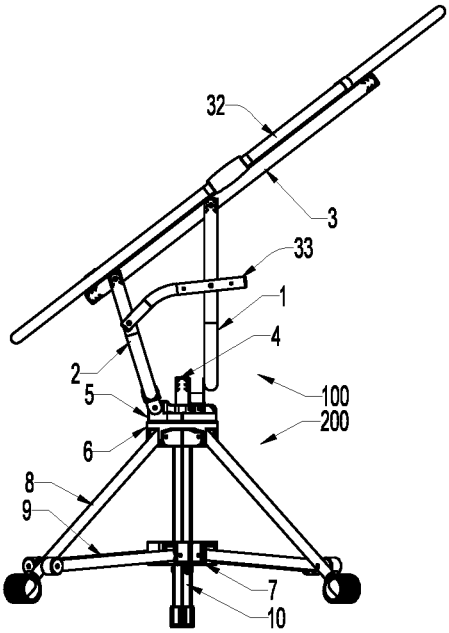
FIG. 13 is a side view of the model swivel chair support frame.
Figure 14:
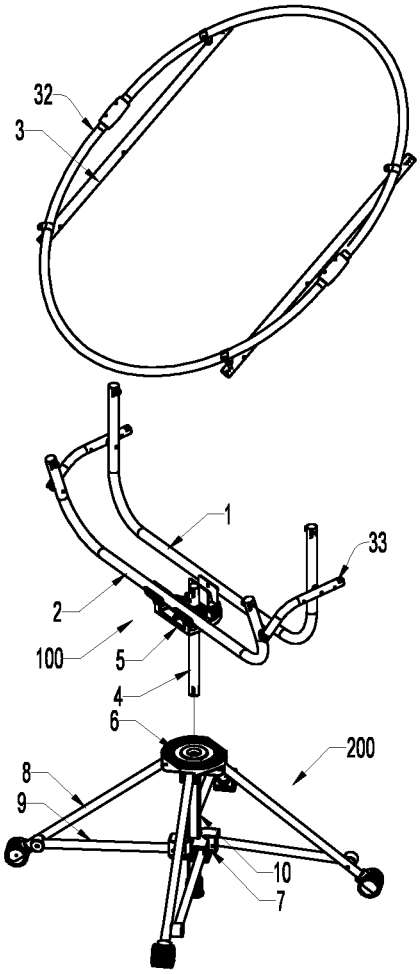
FIG. 14 is a breakdown illustration of the model swivel chair support frame

FIGS. 12-14 show a modeling swivel chair support. The basic structure is similar to that of the first example, except that the plane of the seat cushion rod 3 opened has a large angle with the horizontal plane, and for modeling, the seat cushion rod 3 needs to have two separate sections, and a seat ring 32 with a shape structure is introduced to connect to the seat cushion rod 3. In addition, the introduction of the seat ring 32 also provides a wider hand rest area. The chair leg frame 200 is a general structure and will not be explained in detail. The seat frame 100 is preferably as follows:

The seat frame 100 also includes: a turntable 5, a shaft 4, a seat cushion rod 3, and a first support rod 1 and a second support rod 2 bent into a U-shaped structure. The ends of the first support rod 1 and the second support rod 2 are bent on the same side at the bending sections X, and are rotatably hinged on a cushion rod 3. A seat ring 32 for supporting the seat fabric is locked between the two seat cushion rods 3, and the connection between the two seat cushion rods 3 is formed by the seat ring 32. The seat ring 32 can be a closed structure or an open structure. Since the seat ring 32 is fixedly and connected to the seat cushion rod 3 as a whole, when the seat ring 32 adopts an open structure, it is the same as the examples.

The middle section Y of the first support rod 1 locks to the shaft rod 4. The shaft rod 4 can pass through a reserved hole on the turntable 5. The middle part of the middle section Y of the second support rod 2 is hinged on the turntable 5, and the first support rod 1 and the second support rod 2 are formed by the turntable 5 in a foldable connection.

Furthermore, the bending section of the first support rod 1 is longer than the bending section of the second support rod 2, correspondingly supporting the rear part of the seat, and raising the seat cushion rod 3 and the rear part of the seat ring 32 into a tilted state of low front and high rear. An auxiliary rod 33 is also hinged to the bending sections X of the first support rod 1 and the second support rod 2 and extends out of the first support rod. The auxiliary rod 33 not only plays the role of connecting the first support rod 1 and the second support rod 2 to improve the overall rigidity and improve the smoothness of the opening and folding process, but it also can use the auxiliary rods 33 on both sides to hang the knitted strap between the auxiliary rods 33 to support the seat cushion to avoid excessive "sinking in" when the seat cushion bears a load. It should be noted that the mating seat cushion 300 is a flexible fabric that integrates seating and rest and has a seat cushion portion and a backrest that are formed in one piece, or a flat elastic fabric.

Figure 15:
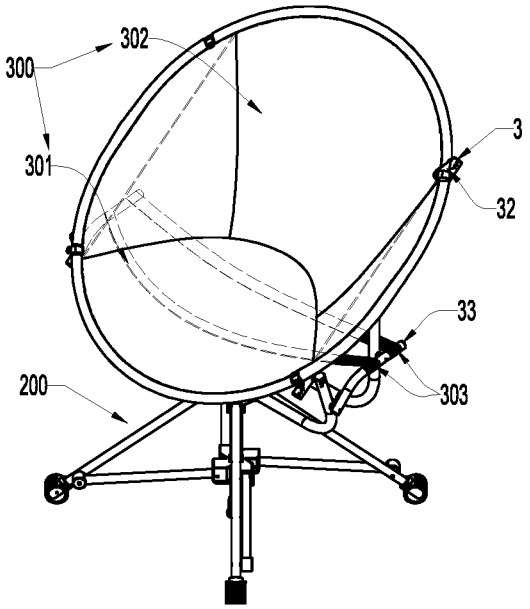
FIG. 15 is an illustration of the model swivel chair.

Referring to FIG. 15, the seat ring 32 of the model swivel chair is shown adopting a closed oval or circular ring. The seat cushion 300 includes a seat cushion portion 301 and a backrest portion 302, both of which are made of flexible fabrics, such as Oxford cloth, and are sewn to form a backrest shape, that is, the seat shape. The edge of the seat cushion 300 is sleeved on the seat ring 32, and the whole is in a suspended state. In order to improve the support strength of the seat, two knitted straps are hung between the two auxiliary rods 33, one at the front and one at the back; the back knitted strap 303 is hung on the auxiliary rod 33 extending out of the first support rod 1. The distance between the two webbings 303 is enlarged, and the seat cushion 302 is supported wider to achieve maximum reinforcement. In addition, the knitted strap 303 can be fixed on the bottom of the seat cushion portion 301 by sewing directly or by compound procedures. The reinforcement solution of the knitted strap 303 is particularly suitable for the structure where the front end of the seat ring 32 is open.

Figure 16:
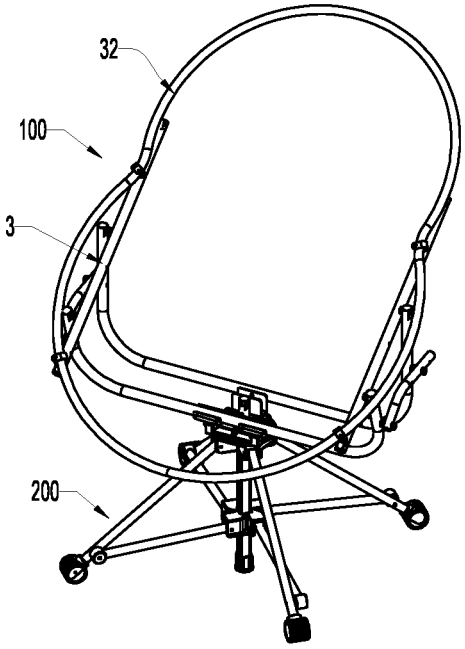
FIG. 16 is an illustration of the seat ring with a gourd-shaped support frame.
Figure 17:
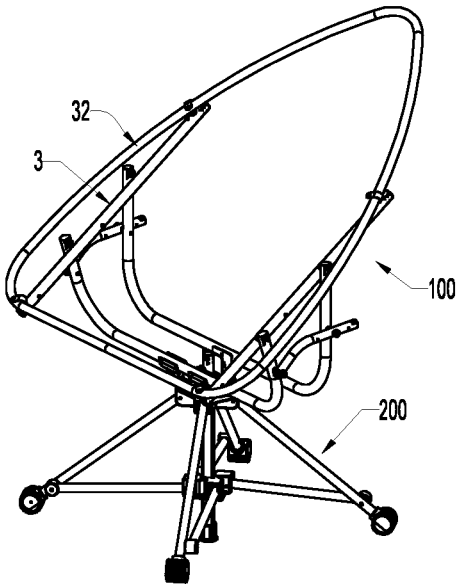
FIG. 17 is an illustration of the seat ring with a triangle support frame.
Figure 18:
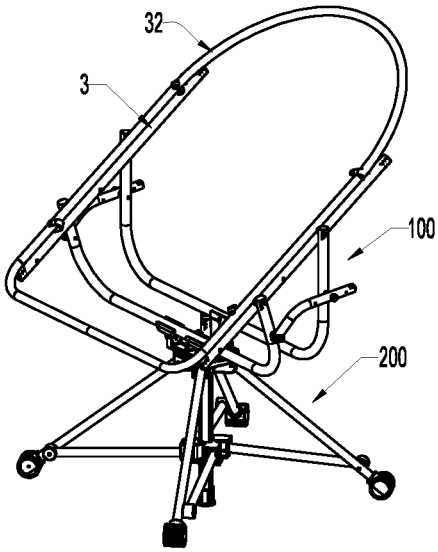
FIG. 18 is an illustration of the seat ring with a bread shape support frame with rounded upper and square bottom.
Figure 19:
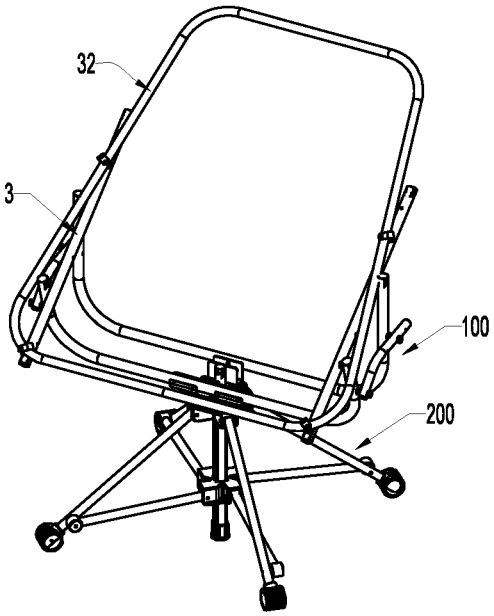
FIG. 19 is an illustration of the seat ring with a trapezoid support frame.
Figure 20:
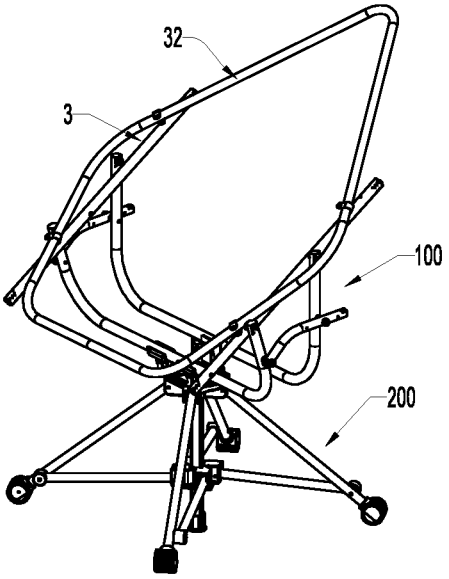
FIG. 20 is an illustration of the seat ring with a pentagon support frame.
Figure 21:
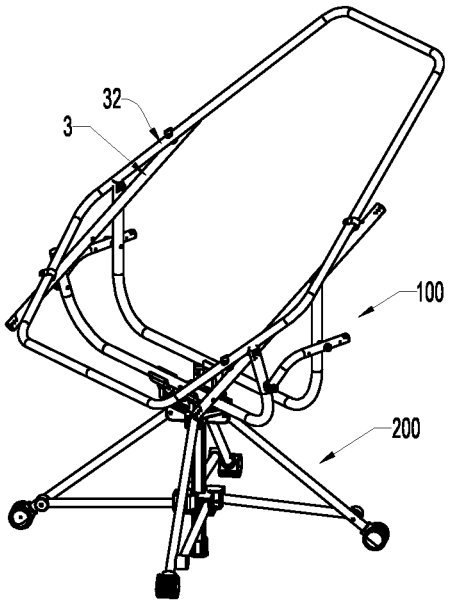
FIG. 21 is an illustration of the seat ring with a hexagon support frame.

This example provides more room for expansion of the folding swivel chair, especially by using the seat ring 32, the following different shapes can be designed:

Elliptical shape as shown in FIG. 12 contains a similar circle;

Gourd shape as shown in FIG. 16;

Triangular as shown in FIG. 17;

Bread shape with a rounded front and a square back as shown in FIG. 18;

Trapezoidal shape as shown in FIG. 19 contains a similar rectangle;

Pentagonal shape as shown in FIG. 20;

Hexagonal shape as shown in FIG. 21; and

Figure 22:
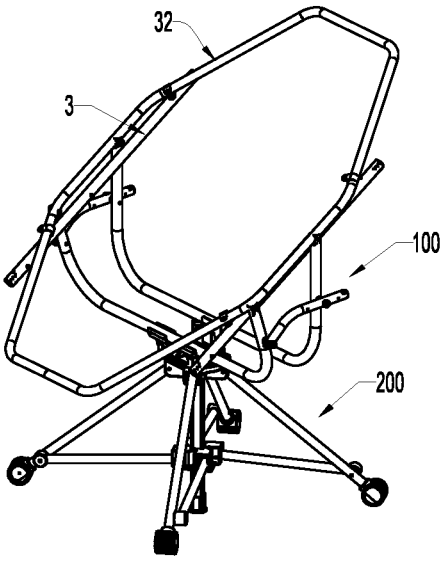
FIG. 22 is an illustration of the seat ring with a octagon support frame.

Octagonal shape as shown in FIG. 22.

The closed seat ring 32 referred to in FIGS. 12, 16 and 22 above can be matched with a seat cushion with a molded seat cushion portion 301 and a backrest 302. The complete swivel chair product is shown in FIG. 15. The flat seat cushion 300 made of elastic materials shown in FIGS. 24 to 27 can be wrapped around the hips and back by gravity deformation after seating to form seat support. The elastic seat cushion 300 also has various weaving solutions, as shown in FIG. 24 to FIG. 27 to meet different design options are met that are not described in details.

Figure 23:
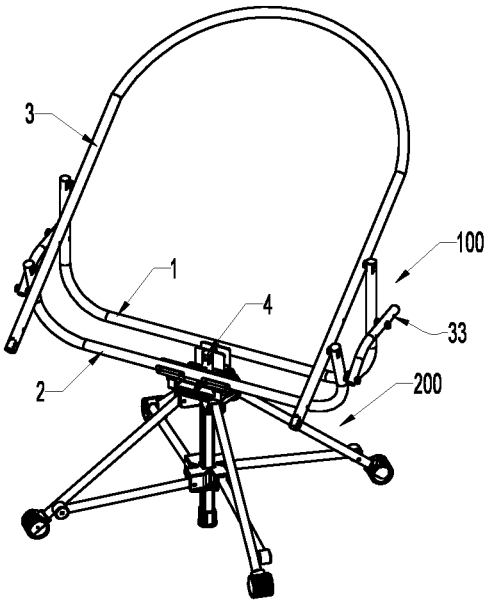
FIG. 23 is an illustration of the open seat ring support frame.
Figure 24:
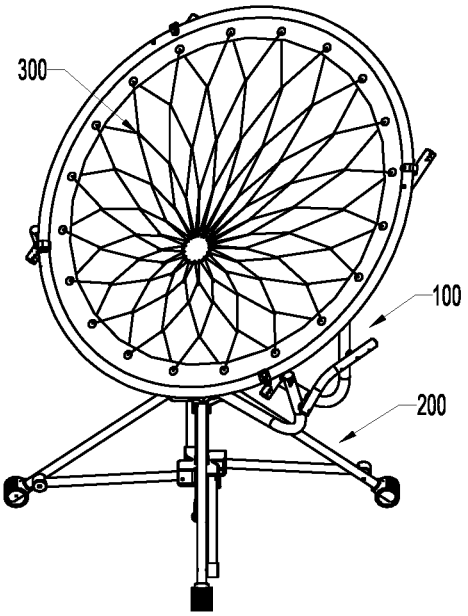
FIG. 24 is an illustration of the use of string-woven elastic seat cushion fabric 1.
Figure 25:
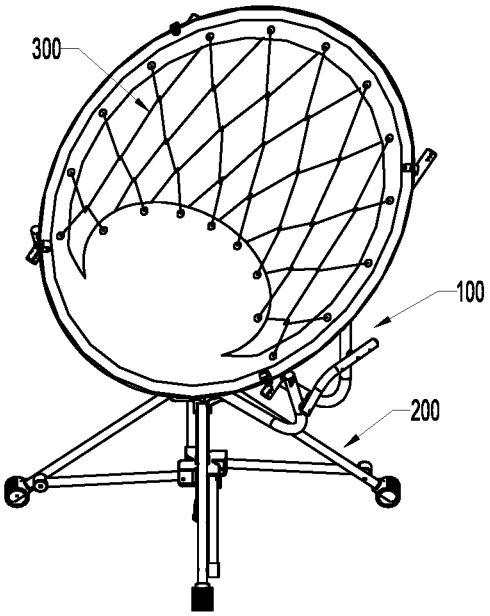
FIG. 25 is an illustration of the use of string-woven elastic seat cushion fabric 2.
Figure 26:
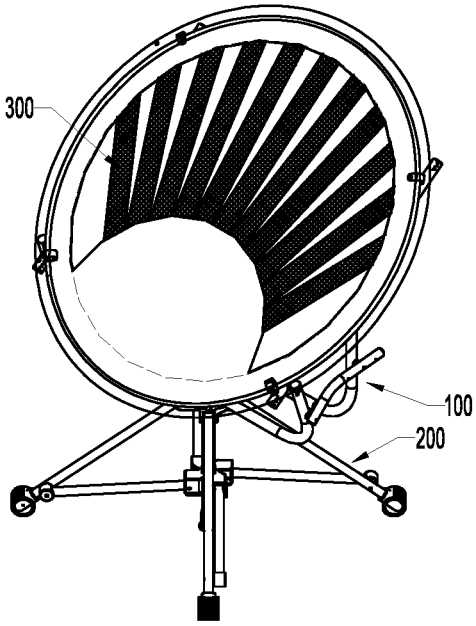
FIG. 26 is an illustration of the use of string-woven elastic seat cushion fabric 3.
Figure 27:
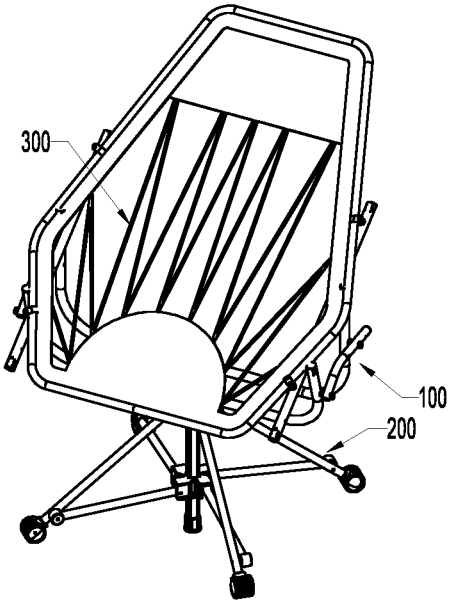
FIG. 27 is an illustration of the use of string-woven elastic seat cushion fabric 4.

Referring to FIG. 23, a bread-shaped opening seat ring solution is shown with a rounded upper and a square bottom. The opening is located between the bending sections X of the second support rod 2 at the front of the seat, corresponding to the position of the legs after sitting. Since both sides of the seat ring 32 overlap with the seat cushion rod 3 in parallel, riveting can be used to strengthen the seat ring, or the two can be integrated and reduced, that is, using cushion rod 3 that is bent into a U shape, similar to the solution in FIG. 2, except that the bending section X of the first support rod 1 is lengthened, and the middle section Y raised by the seat cushion rod 3 forms a backrest support. The direction of the seat is exactly opposite to the solution in FIG. 2.

The advantage of the open seat ring 32 is that in addition to saving a section of material, the legs are softly supported by the fabric of the seat cushion portion 301 and the webbing 303 when sitting avoids the feeling of foreign objects on the rods and provides better comfort. The open seat ring design is also suitable for any kind of seat ring shape.

In summary, the two sides of the shaped seat ring 32 overlap with the two seat cushion rods 3, so they can be combined to reduce processing, or they can be overlapped and strengthened. If they cannot overlap, the seat cushion rod 3 and the seat ring 32 can form a widened area, thus forms the armrest part where the arm can rest and improve comfort. The open seat ring 32 solution is still suitable for any seat ring shape such as round, oval, rectangle, triangle, pentagon, hexagon, octagon, trapezoid, and gourd shape. In addition, when the seat frame 100 is folded, it is only necessary to lift up the back of the seat ring 32 or the seat cushion rod 3 and pull the first support rod 1 and the shaft rod 4 upward.

In addition, it should be noted that when assembling, considering the positional relationship, the first support rod 1 is hinged with the shaft 4, the second support rod 2 is rotatably hinged with the turntable 5, and the seat cushion rod 3 is hinged with the seat ring 32. Excessive use of sheet metal parts is a normal practice.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A support frame for a folding swivel chair comprising:

a chair leg frame having a supporting plate, a sliding plate, a plurality of supporting legs, a plurality of connecting rods, and a guide tube;

the supporting legs having two ends that are hinged on the supporting plate;

one end of each connecting rod is hinged on a respective one of the supporting legs, and another end of each connecting rod is hinged on the sliding plate;

the guide tube is locked on a through hole of the supporting plate and passes through a central hole of the sliding plate;

the chair leg frame forms a rotatable support to a seat frame of the folding swivel chair through the support plate and the guide tube;

the seat frame includes a turntable, a first support rod, a second support rod, and a seat cushion rod that are bent into a U-shape;

the seat cushion rod of the U-shaped structure forms a support for seat cushion;

two bending sections of the first support rod and the second support rod are rotatably hinged on two bending sections of the seat cushion rod to jointly form a support for the seat cushion rod;

a middle section of the first support rod locks to a shaft rod;

the shaft rod can pass through a reserved hole on the turntable;

a middle part of the middle section of the second support rod is hinged on the turntable, and the first support rod and the second support rod are formed by the turntable in a foldable connection.

2. The folding swivel chair support frame of claim 1, wherein when the seat frame is opened in place, a plane formed by the seat cushion rod bent into a U-shaped structure is close to the horizontal plane; and where the middle section of the seat cushion rod faces the front part of the seat, and the two bending sections are positioned on two sides of the seat.

3. The folding swivel chair support frame of claim 2, wherein the two bending sections of the seat cushion rod also have a vertical re-bending of 10 degrees to 20 degrees near the middle section, so that the seat cushion rod forms two planes, and a fabric support strip is also connected to a place where the two bending sections are re-bent.

4. The folding swivel chair support frame of claim 1, wherein two hinged ends of the second support rod and the seat cushion rod have upward extensions forming two second rod extensions, and the backrest support is formed by the two second rod extensions.

5. The folding swivel chair support frame of claim 1, wherein two hinged ends of each of the first support rod, second support rod, and the seat cushion rod have upward extensions, which are respectively a first rod extension and a second rod extension, and a backrest support is formed by two second rod extensions; and an armrest rod is hinged between the end of the first rod extension and the second rod extension.

6. The folding swivel chair support frame of claim 5, wherein the armrest rod is provided with a hinge seat at the hinged position of the end of the first rod extension; and the hinge seat is provided with a transverse slot hole, and a hinged rivet passes through the transverse slot and is fixed at the end of the first rod extension section.

7. A support frame for a folding swivel chair, comprising:

a chair leg frame including a supporting plate, a sliding plate, a plurality of supporting legs, a plurality of connecting rods, and a guide tube;

a plurality of ends of the supporting legs are hinged on the supporting plate;

one end of the corresponding number of connecting rods is hinged on the supporting leg, and an other end is hinged on the sliding plate; and the guide tube is locked on a through hole of the supporting plate and passes through a central hole of the sliding plate;

the chair leg frame forms a rotatable support to a seat frame through the support plate and the guide tube;

the seat frame includes a turntable, a seat cushion rod, and a first support rod and a second support rod bent into a U-shaped structure;

the ends of the first support rod and the second support rod are bent on a same side at the bending sections, and are rotatably hinged on a cushion rod;

a seat ring for supporting a seat fabric is locked between two seat cushion rods, and a connection between the two seat cushion rods is formed by a closed or open seat ring;

a center part of a middle section of the first support rod locks a shaft rod, and the shaft rod can pass through a reserved hole on the turntable;

a middle part of the middle part of the second support rod is hinged on the turntable, and the turntable constitutes the first support rod and the second support rod foldable association.

8. The folding swivel chair support frame of claim 7, wherein a bending section of the first support rod is longer than a bending section of the second support rod, correspondingly supporting a rear part of the seat, and raising the seat cushion rod and the rear part of the seat ring into a tilted state of low front and high rear; and an auxiliary rod is also hinged to the bending sections of the first support rod and the second support rod and extends out of the first support rod.

9. The folding swivel chair support frame of claim 8, wherein the shape of the seat ring is selected from one of the group comprising round; ellipse; rectangle; triangle; pentagon; hexagon; octagon; trapezoid; gourd shape; bread shape with rounded upper and square bottom; and the seat ring is a closed structure.

10. The folding swivel chair support frame of claim 8 wherein the shape of the seat ring is selected from one of the group comprising round; ellipse;

rectangle; triangle; pentagon; hexagon; octagon; trapezoid; gourd shape; bread shape with rounded upper and square bottom; and the seat ring is an open structure, and the opening is located between the bending section of the second support rod at a front part of the seat.

* * * * *